US011465265B2

(12) United States Patent
Ullbors

(10) Patent No.: US 11,465,265 B2
(45) Date of Patent: Oct. 11, 2022

(54) HAND TOOL WITH SELF-RESILIENT HANDLE

(71) Applicant: Pressmaster AB, Alvdalen (SE)

(72) Inventor: Daniel Ullbors, Mora (SE)

(73) Assignee: Pressmaster AB, Alvdalen (SE)

( * ) Notice: Subject to any disclaimer, the term of this patent is extended or adjusted under 35 U.S.C. 154(b) by 161 days.

(21) Appl. No.: 16/624,954

(22) PCT Filed: Jun. 14, 2018

(86) PCT No.: PCT/SE2018/050620
§ 371 (c)(1),
(2) Date: Dec. 20, 2019

(87) PCT Pub. No.: WO2019/013684
PCT Pub. Date: Jan. 17, 2019

(65) Prior Publication Data

US 2020/0223041 A1 Jul. 16, 2020

(30) Foreign Application Priority Data

Jul. 11, 2017 (SE) ..... 1750911-8

(51) Int. Cl.
*B25B 27/14* (2006.01)
*B25B 7/14* (2006.01)

(52) U.S. Cl.
CPC ..... *B25B 27/146* (2013.01); *B25B 7/14* (2013.01)

(58) Field of Classification Search
CPC ..... B25B 27/146
USPC ..... 72/409.01
See application file for complete search history.

(56) References Cited

U.S. PATENT DOCUMENTS 5,138,864 A * 8/1992 Tarpill ..... H01R 43/042 29/751
5,609,080 A 3/1997 Flavigny
6,227,080 B1 * 5/2001 Grayo ..... B25B 7/123 81/368
6,508,149 B1 * 1/2003 Heggemann ..... B25B 27/146 81/320
6,612,206 B1 9/2003 Heggemann et al.
(Continued)

FOREIGN PATENT DOCUMENTS

GB 2072081 9/1981
WO WO 9523048 8/1995

*Primary Examiner* — Hadi Shakeri
(74) *Attorney, Agent, or Firm* — Mark P. Stone

(57) ABSTRACT

A hand tool (1) comprising a first handle (2) and a second handle (3), which are pivotally arranged with respect to each other, a first jaw (4) that is fixed to said first handle (2), the first jaw (4) comprising a first crimp portion (6), and a second jaw (5) comprising a second crimp portion (7), wherein the first and second crimp portions (6,7) are arranged to be moved towards each other by actuation of the first and a second handle (2,3), so as to close a crimp opening (8) formed between said first and second crimp portions (6,7). The second jaw (5) is pivotally arranged with respect to the first handle (2) around a first pivot point (10), and with respect to the second handle (3) around a second pivot point (11) arranged at an upper end of said second handle (3), wherein the first handle (2) comprises a first resilient portion (12) between the first crimp portion (6) and the first pivot point (10), allowing the first crimp portion (6) to flex with respect to the first pivot point (10).

12 Claims, 3 Drawing Sheets

(56) References Cited

U.S. PATENT DOCUMENTS

| | | | | |
|---|---|---|---|---|
| 7,444,907 | B2 * | 11/2008 | Seber | B25B 7/10 81/357 |
| 11,247,308 | B2 * | 2/2022 | Blumenthal | B25B 7/12 |
| 2007/0199364 | A1 * | 8/2007 | Norin | H01R 43/0424 72/409.01 |
| 2017/0170618 | A1 | 6/2017 | Ho et al. | |

* cited by examiner

HAND TOOL WITH SELF-RESILIENT HANDLE

TECHNICAL FIELD

The invention relates to a hand tool with a self-resilient handle. Specifically, the invention relates to such a hand tool where one of the handles is configured to involve an inherent controlled resiliency that allows for objects of different sizes to be crimped in a crimp opening of the tool.

BACKGROUND

In many applications where precision hand tools, such as crimping pliers or the like are utilized, it is desired to manipulate objects of different sizes in the operating area of the tool. For crimping pliers where an object, such as a connector, is crimped between a male and a female tool a larger force will need to be applied to crimp a larger object compared to a relatively smaller object.

In U.S. Pat. No. 6,612,206 B1 a hand tool is disclosed which comprises a resilient connecting element that is arranged between a first handle and an opposite jaw on a hand tool. The resilient connecting element functions to push the handles into an open position and to help adjusting the force acting an object being clamped between the jaws of the hand tool. A drawback of the construction of the hand tool in U.S. Pat. No. 6,612,206 B1 is that its construction is rather complex and includes many parts.

Hence, there is a need of an arrangement for a hand tool that allows objects of different sizes to be crimped with an adequate crimp force in a hand tool with a relatively simple construction, e.g. including fewer parts than a conventional hand tool.

SUMMARY OF THE INVENTION

It is an object of the present invention to provide a hand tool comprising relatively few components that allows objects of different sizes to be operated with varying operating forces.

According to one aspect the invention relates to a hand tool comprising a first handle and a second handle, which are pivotally arranged with respect to each other, first jaw that is fixed to said first handle, the first jaw comprising a first crimp portion, a second jaw comprising a second crimp portion, wherein the first and second crimp portions are arranged to be moved towards each other by actuation of the first and a second handle, so as to close a crimp opening formed between said first and second crimp portions, wherein the second jaw is pivotally arranged with respect to the first handle around a first pivot point, and with respect to the second handle around a second pivot point arranged at an upper end of said second handle. The first handle comprises a first resilient portion between the first crimp portion and the first pivot point, allowing the first crimp portion to flex with respect to the first pivot point.

The fact that the first handle, comprising both the handle and a jaw, comprises a resilient portion has the advantage that no separate resilient system is needed. This has the advantage that the hand tool 1 will be less complex and more durable.

According to a specific embodiment the second pivot point is separated from the first pivot point. Specifically, the second jaw may have an angled shape, wherein the second crimp portion extends substantially orthogonally from the second pivot point with respect to an imagined line between the first pivot point and the second pivot point.

According to one specific embodiment the first handle has a fork arm arrangement comprising a first fork arm and a second fork arm, separated from each other from a point below the first pivot point and upwards, the first fork arm comprising the first crimp portion and the second fork arm enclosing the first pivot point.

According to one specific embodiment a link arm is arranged between the first handle and the second handle.

Specifically, a first end of the link arm may be pivotally arranged at a first link point on a lower part of the first handle and the second end of the link arm may be pivotally arranged at a second link point on an upper part of the second handle.

Preferably the link arm is resilient.

According to one specific embodiment a second resilient portion is arranged along the first handle, between first resilient portion and the first link point on the first handle.

Other embodiments and advantages will be apparent from the detailed description and the appended drawings.

BRIEF DESCRIPTION OF DRAWINGS

An exemplary embodiment related to the invention will now be described with reference to the appended drawings, of which.

DETAILED DESCRIPTION OF EMBODIMENTS

Figure 1:
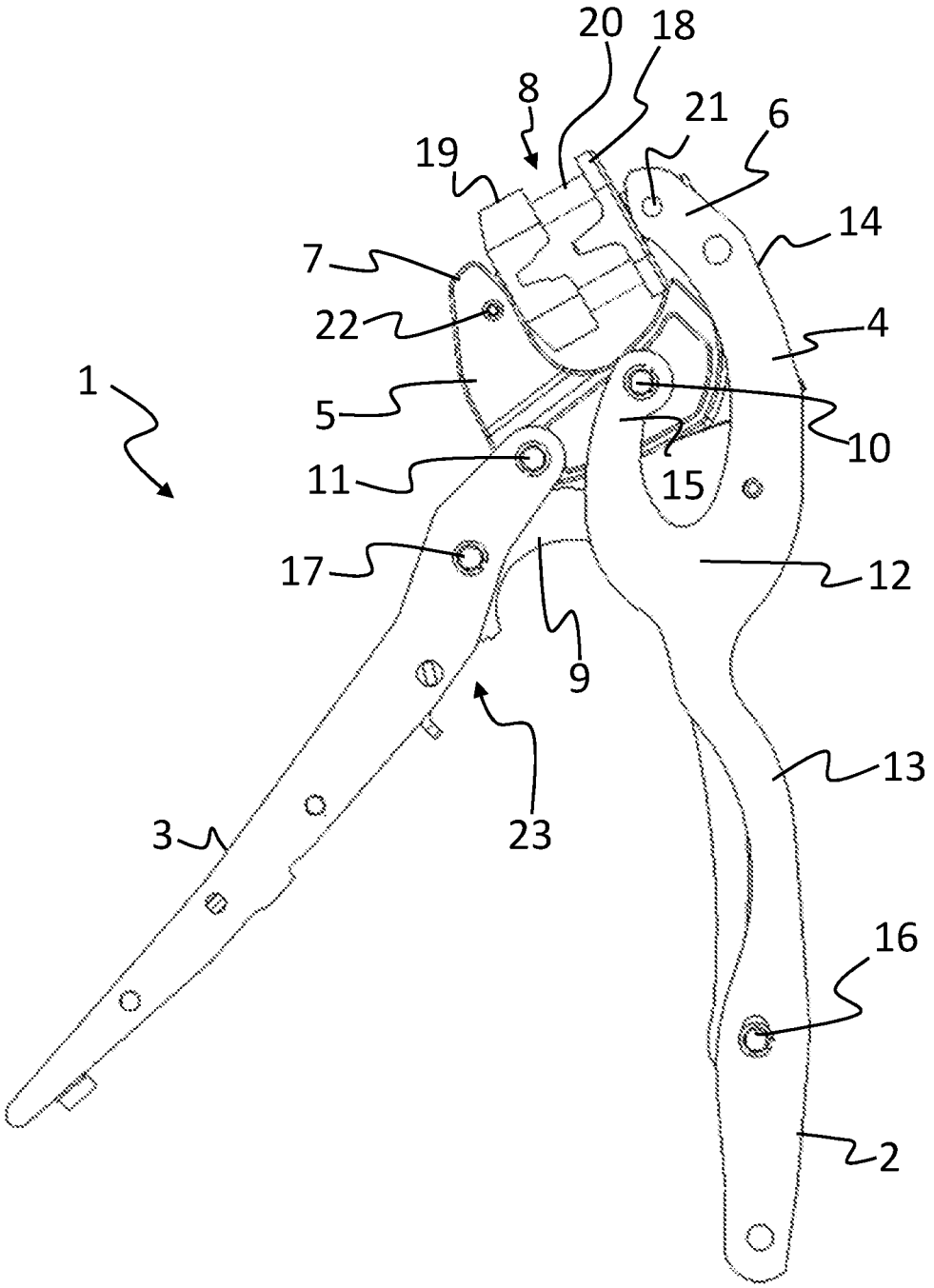
FIG. 1 shows a hand tool in accordance with the invention in an open position.
Figure 2:
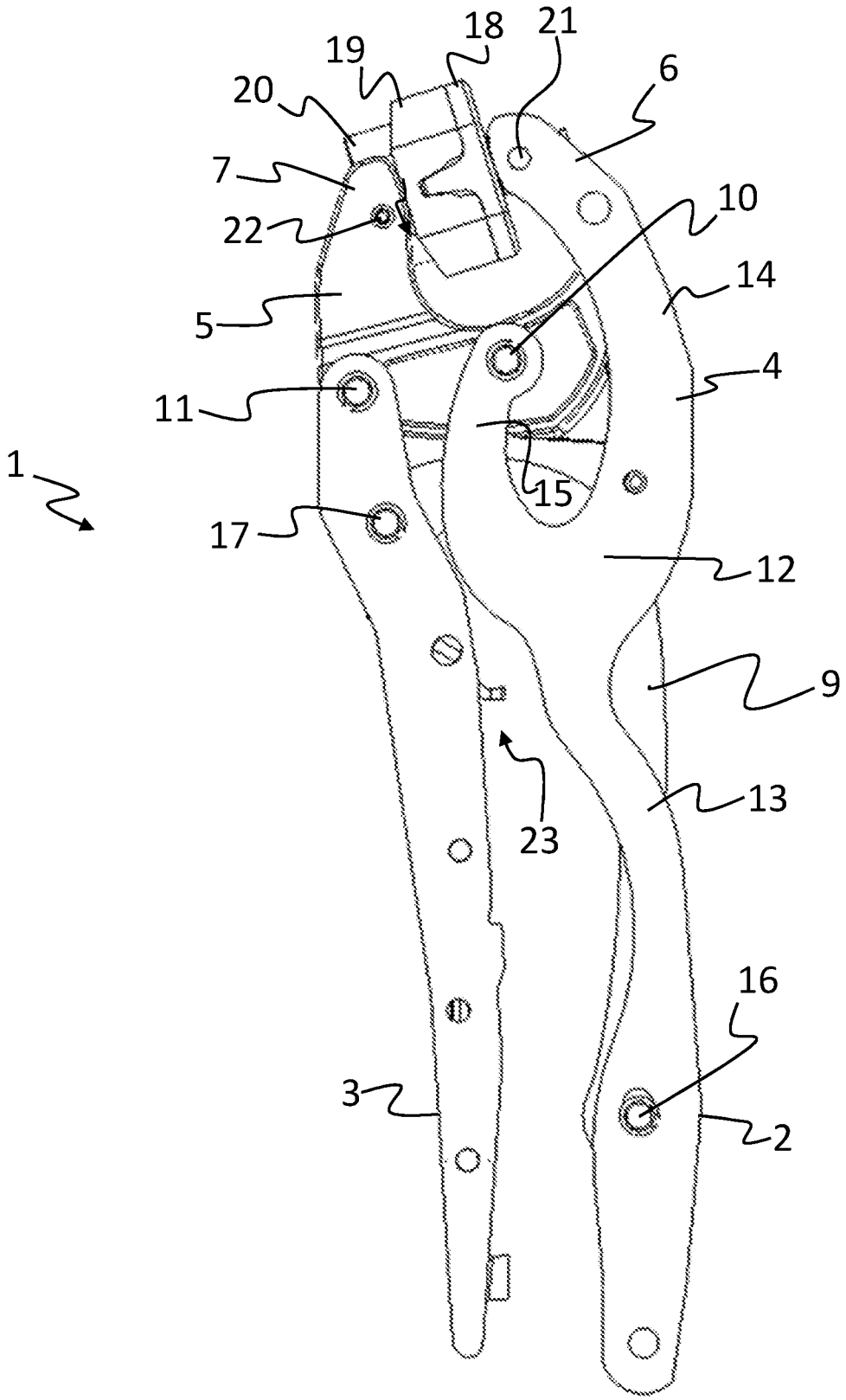
FIG. 2 shows the hand tool of FIG. 1 in a closed position.

In FIG. 1 a hand tool 1 in accordance with a first embodiment of the invention is shown in an open position, and in FIG. 2 the same hand tool 1 is shown in a closed position.

The hand tool 1 comprises a first handle 2 and a second handle 3, which are pivotally arranged with respect to each other by means of a connecting linkage. A first jaw 4 is fixed to the first handle 2, and preferably, the first jaw 4 and the first handle 2 are formed as one integrated part. The first jaw 4 comprises a first crimp portion 6, which is located at an upper end of the first jaw 4.

The hand tool 1 also comprises a second jaw 5 comprising a second crimp portion 7, wherein the first and second crimp portions 6 and 7 are arranged to be moved towards each other by actuation of the first and a second handle 2 and 3, so as to close a crimp opening 8 formed between said first and second crimp portions 6 and 7. In FIG. 1, the handles 2 and 3 are in an open position, separated from each other, and in FIG. 2 the handles have been actuated towards each other to close the crimp opening 8 between the first and second crimp portions 6 and 7.

In the description, the mutual position of details will be described with respect to their position on the hand tool, where the jaws 4 and 5 are defined as the upper part of the tool and the handles are defined to extend downwards from the their respective pivot points, such that the free ends of the handles 2 and 3 are defined as the lowermost parts of the hand tool 1.

The second jaw 5 is pivotally arranged with respect to the first handle 2 around a first pivot point 10, and with respect to the second handle 3 around a second pivot point 11 arranged at an upper end of said second handle 3. In the shown embodiment, the second pivot point 11 is separated from the first pivot point 10. Specifically, the second jaw 5 has an angled shape, wherein the second crimp portion 7 extends substantially orthogonally from the second pivot point 11 with respect to an imagined line between the first pivot point 10 and the second pivot point 11. In other words, the second crimp portion 7 and the first and second pivot point 10 and 11, respectively, forms the angles of a triangle, typically a substantially right angled triangle.

In the shown embodiment, a first die 18 is arranged at a first connection point 21 on the first crimp portion 6, and a second die 19 is arranged at a second connection point 22 on the second crimp portion 7. The hand tool 1 is however suited to other types of dies or grip portions. The dies 18 and 19 are interconnected via a guide arrangement 20, which makes sure that the dies meet each other in a predetermined manner, preferably along a straight line towards each other. The shown dies are adapted to crimp objects of different sizes in the same set of dies. As a general rule, a greater crimping force will be needed the larger the object to be crimped is. With the construction of the inventive hand tool 1 this is automatically achieved by means of a built-in resiliency in the tool frame, i.e. the first handle 2.

Namely, a first resilient portion 12 is arranged between the first crimp portion 6 and the first pivot point 10, allowing the first crimp portion 6 to flex with respect to the first pivot point 10. This first resilient portion 12 helps regulating the force applied to an object located in the crimp opening 8. In the position shown in FIG. 2, with no object in the crimp opening, the dies may be fully closed with little effort. On the contrary, when an object is located in the crimp opening 8 between the dies 18 and 19, the object will prevent the dies from fully closing and a greater force will be needed to position the handles 2 and 3 in the mutual position that corresponds to the fully closed position in an unstressed condition. Further, as is easily understood from the figures, a greater force will be needed to position the handles 2 and 3 in said corresponding mutual position when a larger object is crimped, because said larger object will limit the movement of the dies 18 and 19 towards each other to a greater extent, or at an earlier point, than a relatively smaller object. The inherent resiliency of the first handle 2 will hence allow for objects of different sizes to be crimped in the same set of dies, wherein objects of a greater size automatically will be subjected to a higher clamping force.

In the shown specific embodiment of the hand tool 1 the first handle 2 has a fork arm arrangement comprising a first fork arm 14 and a second fork arm 15, separated from each other from a point below the first pivot point 10 and upwards. The first fork arm 14 comprises the first crimp portion 6, at its upper end and the second fork arm 15 enclosing the first pivot point 10. The first resilient portion 12 is arranged between the first crimp portion 6 and the first pivot point 10.

A link arm 9 is arranged between the first handle 2 and the second handle 3. A first end of the link arm 9 is pivotally arranged at a first link point 16 on a lower part of the first handle 2 and the second end of the link arm 9 is pivotally arranged at a second link point 17 on an upper part of the second handle 3. The link arm 9 is preferably resilient, but it may also be rigid. In all cases it needs to be substantially stiff to fulfill its function. As is apparent from FIGS. 1 and 2 the link arm 9 provides a resilient second link point 17, which functions as a pivot point with respect to the first link point 16, wherein a distance between the upper parts of the handles 2 and 3 is upheld when their respective lower parts are press towards each other, such that the second pivot point 11 will be brought in rotation (clockwise in the figures) around the first pivot point 10, wherein the second jaw will be rotated (clockwise) to bring the second crimp portion 7 towards the first crimp portion 6.

Also, in the shown embodiment a second resilient portion 13 is arranged along the first handle 2 between first resilient portion 12 and the first link point 16 on the first handle 2. This second resilient portion 13 allows the lowermost part of the active part of the first handle 2 to flex. Active part in this case signifies that it contributes to the pressing during a crimping operation.

With the first resilient portion 12, the second resilient portion 13 and the slightly resilient link arm 9, a complete arrangement of resiliency is accomplished, in which each resilient component contributes to the total resiliency of the system.

In conjunction with the attachment of the link arm 9 to the second handle 3 a release device 23 is arranged and makes sure that the handles will need to be pressed towards each other to a specific point before they may be pulled apart from each other. This device works well in combination with the inventive resiliency system that allows objects of different sizes to be crimped in the same set of dies, wherein objects of a relatively larger size will be subjected to a greater crimping force than relatively smaller objects. This is of course due to that size of the object will force the resilient portions to deform elastically more the greater the object is, such that a greater force will be needed to bring the handles to the mutual position where the release device is released.

In the specific embodiment, the resilient portions interact to provide a complete resilient system. If, however, these resilient portions were to be isolated from each other their function could be described as follows: The first resilient portion 12 allows the first crimp portion 8 to flex with respect to the opposed second crimp portion 9. Hence, the stiffer the first resilient portion 12 is, the greater the force needed to crimp a relatively large object will be. The second resilient portion 13 will allow the first handle 2 to flex towards the second handle 3 so as to allow the release function 23 to release the handles and indicate that the crimping operation is concluded. The link arm 9 may have several functions. In the case were the link arm is stiff, the resilient system will consist of the first and second resilient portions 12 and 13, respectively, and an increased stiffness of both of these will increase the force needed to crimp a relatively large object.

However, a resilient link arm 9, will contribute in a synergetic manner, providing a new resilient system. Namely, a relatively greater resiliency of the link arm 9 will allow the first handle 2 to close towards the second handle 3 with a relatively lower force exposed in the second link point 17. This will result in that the second crimp portion 7 will not need to be fully closed towards first crimp portion 6. Thereby, the resiliency of the link arm 9 also provides a resilience in the crimping area for a specific position of the handles.

According to one aspect all the resilient portions contributes to the overall resilience, such that the stress on each of these zones will be distributed over these different resilient portions. Hence, the forces acting on each resilient portions of the tool during operation will be reduced, thereby reducing the overall fatigue and resulting in a prolonged life cycle of the tool.

Further though, in the shown embodiment, the link arm 9 comprises the release function 23, and an increased resiliency of the link arm 9 will make the release function reach its release point later the greater the object positioned in the crimp opening 8 is. Hence, if the handles are closed, although the crimp opening 8 remains open to a great degree due to an object blocking said crimp opening 8, the second link point 11 and the second link point 17 will be in a relatively low position. This will force the link arm 9 to flex greatly to allow the handles 2 and 3 to close, which will affect the release function 23 to release at a relatively late point with respect to the position of the handles 2 and 3. i.e., such that the handles need to be more tightly closed towards each other.

Figure 3:
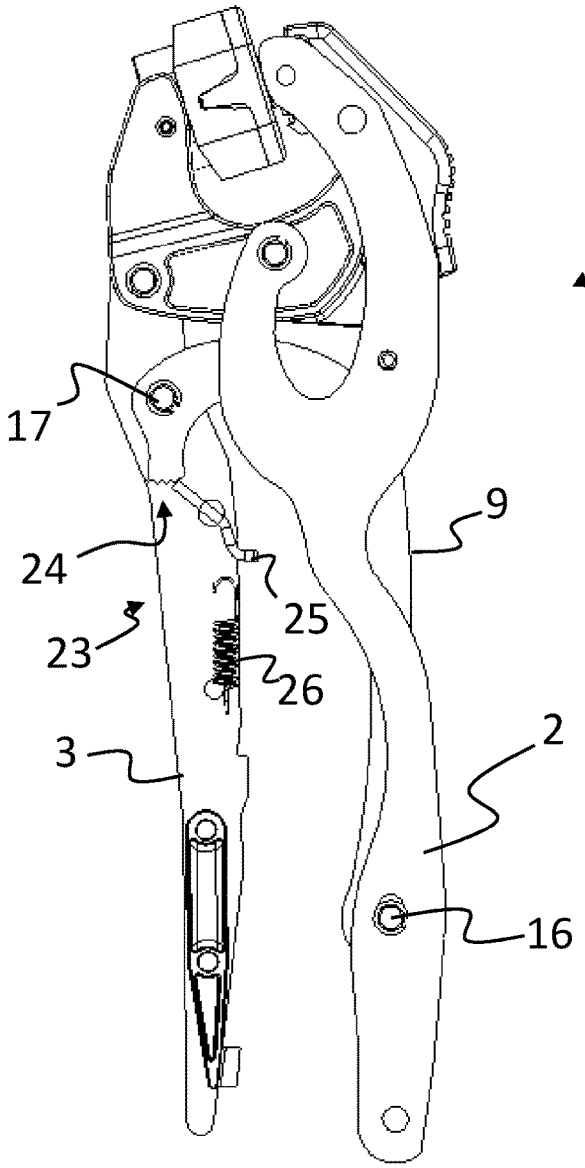
FIG. 3 shows the hand tool of FIG. 1 with an exposed release function.
Figure 4:
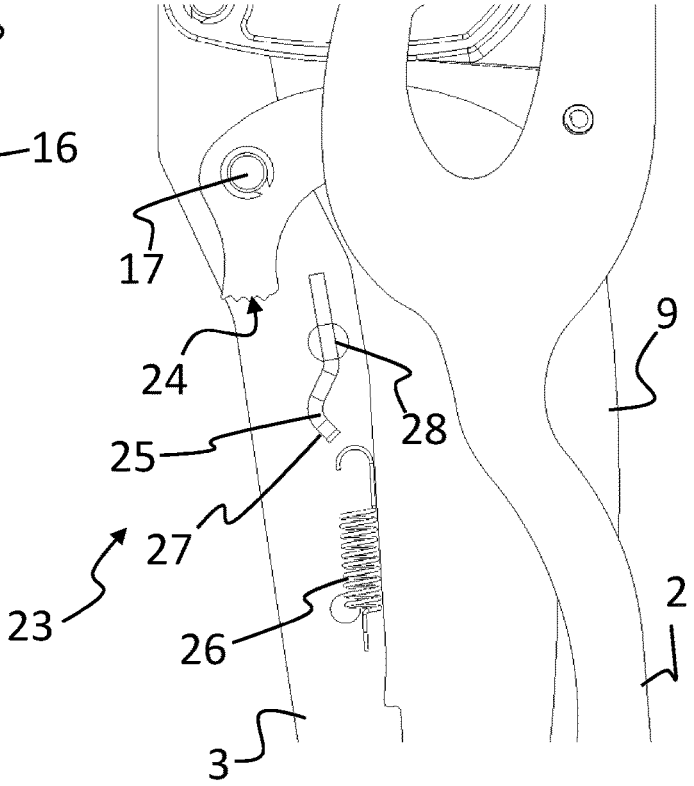
FIG. 4 shows a close-up of the release function of FIG. 3 in a released position.

A specific embodiment of the release function 23 is more closely shown in FIGS. 3 and 4. In FIG. 3 the release function 23 is shown in a position right before it is about to be released and in FIG. 4 it has been released. The release function 23 comprises a ratchet 24, which in the shown embodiment is an integral part of the link arm 9. With this type of release function the link arm is preferably resilient. A pawl 25 is arranged to interact with the ratchet 24 so as to impede that the handles 2 and 3 are parted from each other during a crimping operation where the handles are closed towards each other. A pawl spring 26 is arranged to stress the pawl 25 towards an initial position pointing towards the ratchet 24. As is apparent in FIG. 2 the pawl 25 is connected to the pawl spring 26 at a spring connection 27 at an end of the pawl 25 that is opposite to the active end of the pawl that interacts with the ratchet 24. The pawl 25 is pivoted around a pawl pivot point 28 arranged on the second handle 3.

As is apparent to a person skilled in the art the release function may be arranged in many different ways. For instance, the release function may be arranged to depend only of the mutual position of the handles 2 and 3, always releasing at the same mutual position of the handles 2 and 3 irrespective of the size of the object in the crimping area. Further, in a specific embodiment, the release function may be reciprocally proportional to the size of the object to be clamped, such that the release function will be released at relatively early point with respect to the position of the handles 2 and 3 for a relatively greater object, i.e. such that the handles does not need to be fully closed towards each other.

Above, the invention has been described with reference to specific embodiments. The invention is however not limited to these embodiments. It is obvious to a person skilled in the art that other embodiments are possible within the scope of the following claims.

The invention claimed is:

1. A hand tool (1) comprising:

a first handle (2) and a second handle (3), which are pivotally arranged with respect to each other, a first jaw (4) that is fixed to said first handle (2), the first jaw (4) comprising a first crimp portion (6), a second jaw (5) comprising a second crimp portion (7), wherein the first and second crimp portions (6,7) are arranged to be moved towards each other by actuation of the first and the second handle (2,3), so as to close a crimp opening (8) formed between said first and second crimp portions (6,7), wherein the second jaw (5) is pivotally arranged with respect to the first handle (2) around a first pivot point (10), and with respect to the second handle (3) around a second pivot point (11) arranged at an upper end of said second handle (3), the second pivot point (11) being separated from the first pivot point (10) characterized in that the first handle (2) comprises a first resilient portion (12) integrally formed with the first handle (2) defining a fork arm arrangement allowing the first crimp portion (6) to flex with respect to the first pivot point (10), wherein said fork arm arrangement comprising a first fork arm (14) and a second fork arm (15), separated from each other from a point below the first pivot point (10) and upwards, the first fork arm (14) comprising the first crimp 2 portion (6) and the second fork arm (15) enclosing the first pivot point (10), and wherein a link arm (9) is arranged between the first handle (2) and the second handle (3).

2. The hand tool (1) according to claim 1, wherein a first end of the link arm (9) is pivotally arranged at a first link point (16) on a lower part of the first handle (2) and that the second end of the link arm (9) is pivotally arranged at a second link point (17) on an upper part of the second handle (3).

3. The hand tool (1) according to claim 2, wherein the link arm (9) is resilient.

4. The hand tool (1) according to claim 2, wherein a second resilient portion is arranged (13) along the first handle (2), between said first resilient portion (12) and the first link point (16) on the first handle (2).

5. The hand tool (1) according to claim 1, wherein the link arm (9) is resilient.

6. The hand tool (1) according to claim 5, wherein a second resilient portion is arranged (13) along the first handle (2), between said first resilient portion (12) and a first link point (16) on the first handle (2).

7. The hand tool (1) according to claim 1, wherein a second resilient portion is arranged (13) along the first handle (2), between said first resilient portion (12) and a first link point (16) on the first handle (2).

8. A hand tool (1) comprising:

a first handle (2) and a second handle (3), which are pivotally arranged with respect to each other, a first jaw (4) that is fixed to said first handle (2), the first jaw (4) comprising a first crimp portion (6), a second jaw (5) comprising a second crimp portion (7), wherein the first and second crimp portions (6,7) are arranged to be moved towards each other by actuation of the first and the second handle (2,3), so as to close a crimp opening (8) formed between said first and second crimp portions (6,7), wherein the second jaw (5) is pivotally arranged with respect to the first handle (2) around a first pivot point (10), and with respect to the second handle (3) around a second pivot point (11) arranged at an upper end of said second handle (3), the second pivot point (11) being separated from the first pivot point (10) characterized in that the first handle (2) comprises a first resilient portion (12) between the first crimp portion (6) and the first pivot point (10), allowing the first crimp portion (6) to flex with respect to the first pivot point (10), wherein the first handle (2) has a fork arm arrangement comprising a first fork arm (14) and a second fork arm (15), separated from each other from a point below the first pivot point (10) and upwards, the first fork arm (14) comprising the first crimp portion (6) and the second fork arm (15) enclosing the first pivot point (10), and wherein a link arm (9) is arranged between the first handle (2) and the second handle (3), wherein the second jaw (5) has an angled shape, and wherein the second crimp portion (7) extends substantially orthogonally from the second pivot point (11) with respect to an imagined line between the first pivot point (10) and the second pivot point (11).

9. The hand tool (1) according to claim 8, wherein a first end of the link arm (9) is pivotally arranged at a first link point (16) on a lower part of the first handle (2) and that the second end of the link arm (9) is pivotally arranged at a second link point (17) on an upper part of the second handle (3).

10. The hand tool (1) according to claim 9, wherein a second resilient portion is arranged (13) along the first handle (2), between said first resilient portion (12) and the first link point (16) on the first handle (2).

11. The hand tool (1) according to claim 8, wherein the link arm (9) is resilient.

12. The hand tool (1) according to claim 8, wherein a second resilient portion is arranged (13) along the first handle (2), between said first resilient portion (12) and a first link point (16) on the first handle (2).

* * * * *